US005425504A

United States Patent [19]

Patterson

[11] Patent Number: 5,425,504

[45] Date of Patent: Jun. 20, 1995

[54] WATER CANNON LIQUID DISPENSING SYSTEM

[76] Inventor: James Patterson, 214-2885 Boys Road, Duncan, British Columbia, Canada, V9L 4Y9

[21] Appl. No.: 149,773

[22] Filed: Nov. 10, 1993

[51] Int. Cl.[6] ..... B05B 13/00

[52] U.S. Cl. ..... 239/11; 239/99; 239/124

[58] Field of Search ..... 239/99, 101, 124, 11; 169/24, 25, 51

[56] References Cited

U.S. PATENT DOCUMENTS

| | | | |
|---|---|---|---|
| 2,295,228 | 9/1942 | Malsbary et al. | 239/99 X |
| 3,361,354 | 1/1968 | Johnston | 239/11 |
| 3,712,543 | 1/1973 | Clipp et al. | 239/99 |
| 3,722,819 | 3/1973 | Hall et al. | 239/99 |
| 4,007,793 | 2/1977 | Hux et al. | 239/172 X |
| 4,058,256 | 11/1977 | Hobson et al. | 239/172 X |
| 4,488,603 | 12/1984 | Schmittman et al. | 239/172 X |
| 4,573,637 | 3/1986 | Pater et al. | 239/99 X |
| 4,653,532 | 3/1987 | Powers | 239/124 X |
| 4,723,710 | 2/1988 | Lucore, II | 239/124 |
| 4,768,713 | 9/1988 | Roper | 239/99 X |
| 4,809,909 | 3/1989 | Kukesh | 239/124 X |
| 4,835,903 | 6/1989 | Kückens | 239/124 X |

*Primary Examiner*—Andres Kashnikow
*Assistant Examiner*—Lisa Douglas
*Attorney, Agent, or Firm*—Dickstein, Shapiro & Morin

[57] ABSTRACT

A water cannon is arranged for both pulsed and continuous flow. A turret is provided for supporting and aiming a water cannon nozzle. Advantageously, the water cannon includes a pump which accelerates water through a closed loop until operation of a first valve directs the water to the turret. In the pulsed mode, a second valve keeps the nozzle normally closed, and the flow causes pressure in an air chamber to increase above a predetermined level, thereby opening the second valve and allowing the water to exit the nozzle. This flow reduces the pressure in the air chamber below the predetermined level. As a result, the second valve is actuated to stop the flow. In the continuous flow mode, the second valve is maintained open to allow the flow directed from the closed loop to exit the nozzle in a continuous flow.

18 Claims, 4 Drawing Sheets

WATER CANNON LIQUID DISPENSING SYSTEM

BACKGROUND OF THE INVENTION

The present invention relates generally to liquid dispensing systems. In particular, the present invention relates to a water cannon which selectively operates in pulsed and continuous flow modes. The present invention also relates to a turret for use in a water cannon.

Water cannons capable of firing in a pulsed mode are disclosed in U.S. Pat. No. 3.712,543 (Clipp), U.S. Pat. No. 3,722,819 (Hall), U.S. Pat. No. 4,058,256 (Hobson), and U.S. Pat. No. 4,573,637 (Pater).

SUMMARY OF THE INVENTION

The present invention improves upon the prior art by providing a water cannon which is capable of being selectively operated in pulse and/or continuous flow modes. The present invention is uncomplicated, comprising a minimal number of moving parts, and is economical to manufacture.

In one aspect of the invention, a water cannon includes a water reservoir, a pump for accelerating the water, a closed loop within which the water may be accelerated, a turret for directing the flow of water, and a system for diverting the flow from the closed loop to the turret. The system for diverting the flow to the turret includes first and second solenoid valves. The first valve directs the fluid from the closed loop to the turret and the second valve allows the water to exit the turret nozzle. The second valve is opened when sufficient pressure is developed in an air chamber attached to a conduit connecting the closed loop to the turret.

The present invention also relates to a turret for directing and controlling a water cannon. The turret includes a handle and a nozzle pivotably connected to a base portion. In a preferred embodiment of the invention, the base portion receives the water and stores it until the second solenoid valve allows the flow to exit the nozzle. A handle with left and right triggers for operating first and second solenoid valves may also be provided.

An object of the present invention is to provide a water cannon capable of operating in pulsed and continuous flow modes.

Another object of the present invention is to provide a water cannon that is inexpensive to manufacture.

Another object of the invention is to provide an improved turret for a water cannon.

Other objects and advantages of the present invention will become apparent from the following detailed description and drawings which illustrate preferred embodiments of the present invention.

DETAILED DESCRIPTION OF PREFERRED EMBODIMENTS

Figure 1:
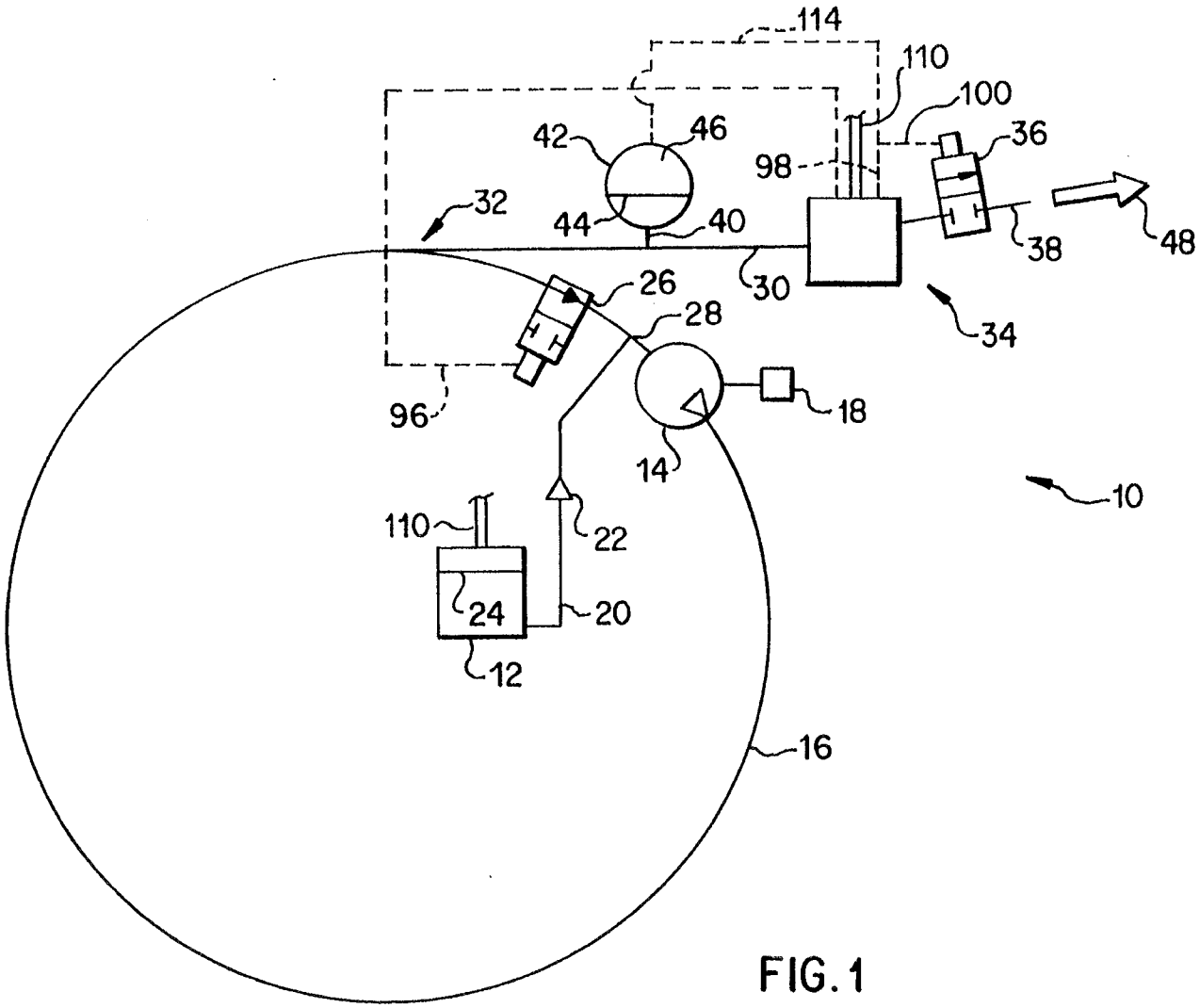
FIG. 1 is a schematic view of a water cannon constructed in accordance with a preferred embodiment of the present invention.

Referring now to the drawings, where like reference numerals indicate like elements, there is shown a water cannon 10 constructed in accordance with a preferred embodiment of the present invention.

The water cannon 10 includes a source of water 12, a pump 14 and a closed loop 16. A motor 18 is provided for operating the pump 14. The closed loop 16 is connected to the source 12 by a first conduit 20. When the pump 14 is operated, water is drawn from the source 12 and accelerated around the closed loop 16. A one-way valve 22 may be placed in the first conduit 20 to prevent water from flowing from the closed loop 16 back into the source 12. The source 12 may be in the form of a reservoir with a water level 24. Means (not illustrated) may be provided for automatically maintaining the water level 24 within a predetermined range.

The closed loop 16 is preferably a tubular conduit with an inside diameter of about two inches (about five centimeters) and a length of approximately one hundred feet (about thirty meters). In such a configuration, the closed loop 16 would hold about one hundred pounds (about forty-five kilograms) of water. The closed loop 16 is shown schematically as a single loop, but may alternatively be coiled about itself in a sufficient number of loops such that its one hundred foot length may be accommodated in a smaller area.

A first solenoid valve 26 is located in the closed loop 16. The first valve 26 is located close to the connection 28 of the supply conduit 20 to the closed loop 16. Preferably, the supply connection 28 is also located close to the pump 14. The first valve 26 is normally open allowing the pump 14 to circulate the water through the closed loop 16 until the water reaches a high velocity. When the first valve 26 is closed, the flow of water is diverted from the closed loop 16 into a second connecting conduit 30. The second connecting conduit 30 is connected to the closed loop 16 by a Y-shaped conduit portion 32. The second conduit 30 directs the water to a turret 34.

A second solenoid valve 36 is normally closed to prevent the water from exiting a nozzle 38. Consequently, when the first valve 26 is closed, water surges through a third conduit 40 into an air chamber 42. Water entering the air chamber 42 causes the water level 44 to rise, thus compressing a pocket of air 46 located above the water level 44. The water entering the chamber 42 increases the pressure in the chamber 42 to a predetermined level whereupon the second solenoid valve 36 is opened allowing the water to exit the nozzle 38. The water exits the nozzle 38 in the direction indicated by the arrow 48.

Figure 2:
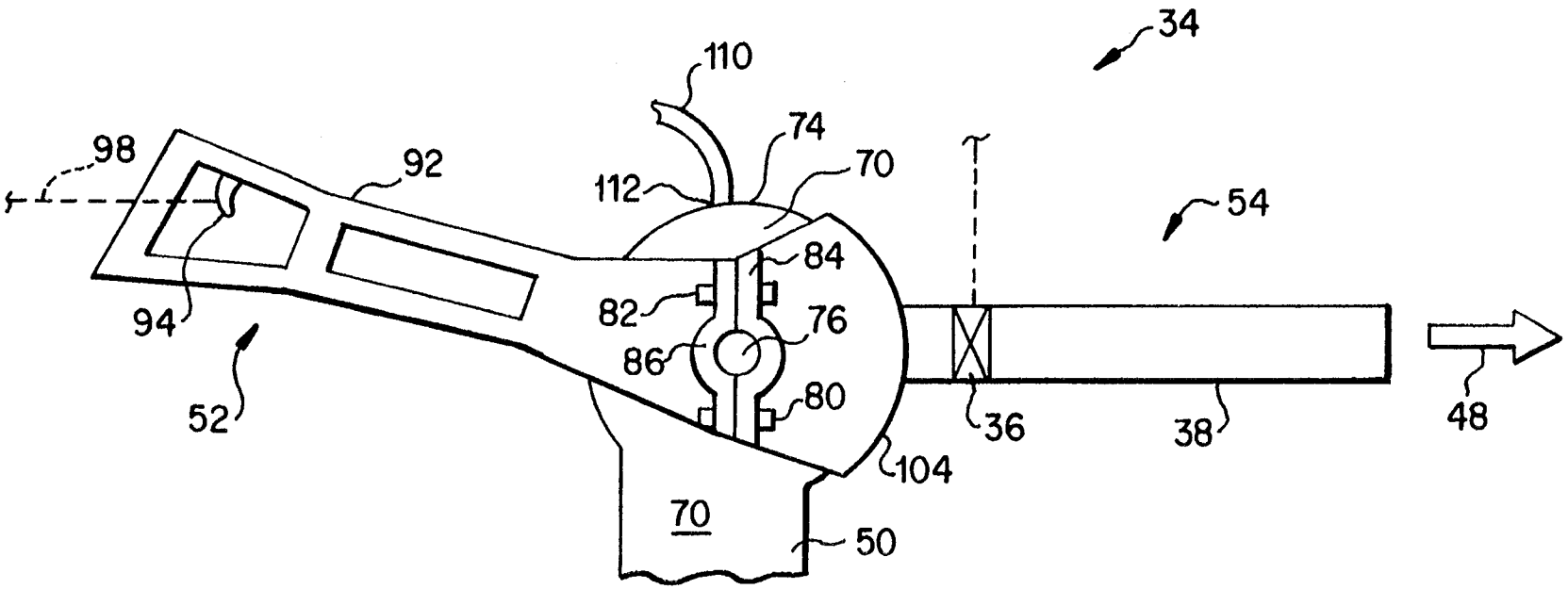
FIG. 2 is a side view of a turret for the water cannon of FIG. 1.
Figure 3:
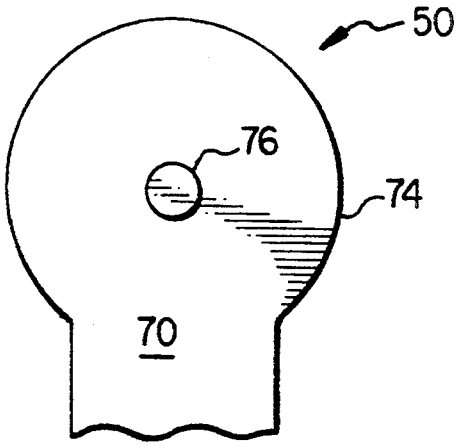
FIG. 3 is a side view of the base of the turret of FIG. 2.
Figure 4:
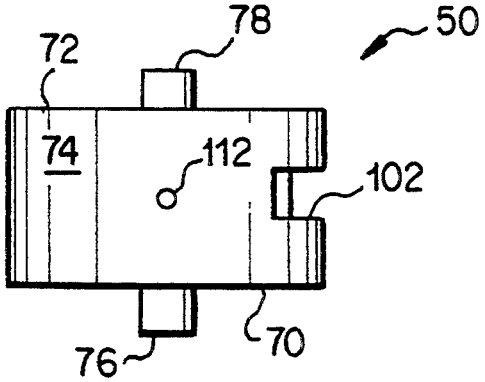
FIG. 4 is a top view of the turret base of FIG. 2.

The aim of the nozzle 38 may be adjusted vertically and horizontally by the turret 34. As illustrated in FIG. 2, the turret 34 includes a base portion 50, a handle portion 52 and a nozzle portion 54. The base portion 50 includes two substantially planar side panels 70, 72 (FIG. 4) and a cylindrical center portion 74. The panels 70, 72 and center portion 74 may be made of sheet metal. Two studs 76, 78 project outwardly from the side panels 70, 72. The handle portion 52 and the nozzle portion 54 are connected to each other by bolts or rivets 80, 82 (FIG. 2) such that the handle portion 52 and the nozzle portion 54 pivot vertically about the studs 76, 78.

The rivets 80, 82 extend through flanges 84, 86 at the inner ends of the handle and nozzle portions 52, 54. The base portion 50 may be supported in such a way as to rotate horizontally. The second valve 36 is located within the nozzle portion 54 to control the water flow through the nozzle 38.

Figure 6:
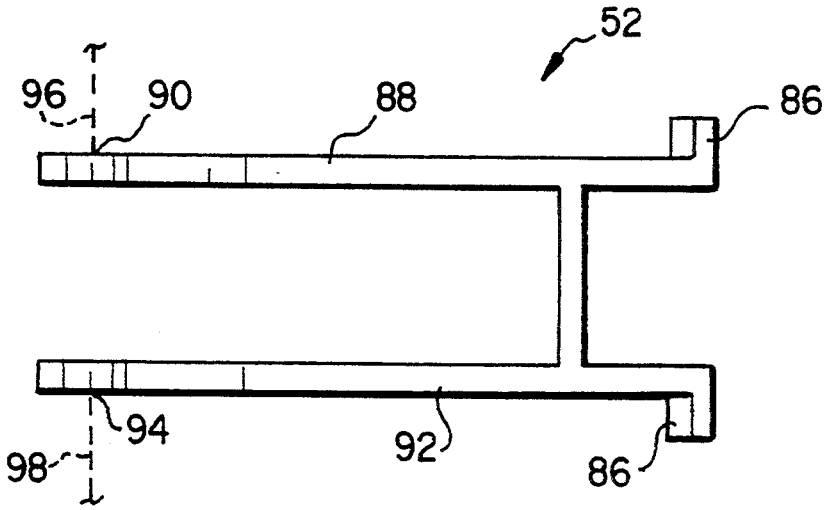
FIG. 6 is a top view of the handle of the turret of FIG. 2.
Figure 7:
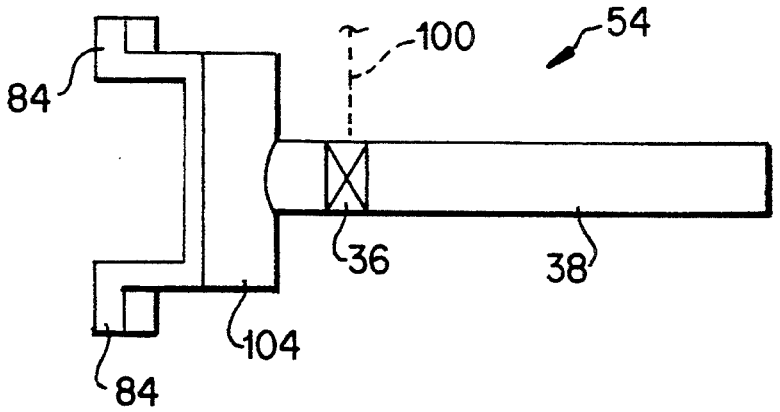
FIG. 7 is a top view of the nozzle of the turret of FIG. 2.

As seen in FIG. 6, the handle portion 52 includes a left handle 88, a left trigger 90, a right handle 92, and a right trigger 94. The first solenoid valve 26 is connected to the left trigger 90 by an electrical or pneumatic signal .line 96 such that the first valve 26 is closed when the left trigger 90 is depressed. The right trigger 94 is connected to the second solenoid valve 36 by second and third electrical or pneumatic signal lines 98, 100 such that the second valve 36 is opened when the right trigger 94 is depressed.

Figure 5:
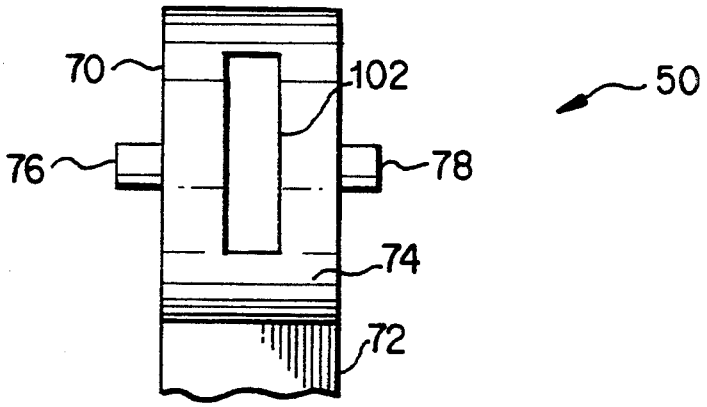
FIG. 5 is a front view of the turret base of FIG. 2.

As seen in FIG. 5, the cylindrical center portion 74 has an opening 102 which may advantageously be an elongated slot. The water directed through the second conduit 30 into the base portion 50 exits the base portion 50 through the opening 102 and thereby enters the nozzle 38. The opening 102 is preferably in the form of an elongated arcuate rectangle. Therefore, the nozzle 38 can be pivoted up and down by the handle portion 52 through a range of positions while remaining in fluid communication with the second conduit 30. The nozzle portion 54 has a semi-cylindrical cap member 104 for forming a seal over the opening 102.

As illustrated in FIGS. 1 and 2, the base portion 50 may be connected to the top of the reservoir 12 by a flexible vent conduit 110. The vent conduit 110 may be connected to an opening 112 (FIG. 4) located at the top of the base portion 50. The size of the conduit 110 would be determined by the size of the water cannon 10. The purpose of the vent conduit 110 would be to prevent the formation of an air pocket within the base portion 50.

Further, moving water may become very turbulent. If the water within the cannon 10 became too turbulent, the cannon 10 may not function as desired. Accordingly, it may be desirable to provide flutes, vanes or other known turbulence reducing means within the base portion 50 and/or within the nozzle 38. The flutes, vanes or other turbulence reducing means (not illustrated) would reduce the total amount of turbulence within the cannon 10.

Operation of the water cannon 10 is as follows. The pump 14 pumps water through the closed loop 16. The first solenoid valve 26 is initially open, and the second solenoid valve 36 is initially closed. Accordingly, the pump 14 accelerates the water through the closed loop 16 until the water reaches a predetermined desired velocity.

To operate the cannon 10 in a pulsed mode, the first solenoid valve 26 is closed by depressing the left trigger 90. This causes the water to be directed into the second conduit 30 toward the base portion 50 of the turret 34. Because the second solenoid valve 36 is closed, the water cannot at first exit the nozzle 38. Therefore, the water enters the air chamber 42 through the third conduit 40. This causes the pressure in the air chamber 42 to increase to a predetermined level. At the predetermined pressure level, a pressure switch (not illustrated) located within the chamber 42 is actuated, The pressure switch is connected to the second valve 36 by a fourth electrical or pneumatic signal line 114 (and by the third signal line 100). Thus, when the pressure switch is actuated, the second solenoid valve 36 is moved to an open position to allow water to exit the nozzle 38 with great kinetic energy (with greater kinetic energy than could otherwise be produced by the pump 14).

The flow of water through the nozzle 38 reduces the pressure in the chamber 42 below the predetermined level. As a result, the pressure switch is de-actuated, and the second solenoid valve 36 returns to its closed position. This in turn causes fluid flow to pressurize the air chamber 42 above the predetermined pressure level at which point the second solenoid valve 36 is reopened. The above-described procedure repeats itself while the left trigger 90 remains depressed. Thus, the water cannon 10 provides pulsed flow through the nozzle 38. When the left trigger 90 is released, the first solenoid valve 26 is opened, whereupon the pump 14 causes the fluid to once again be accelerated through the closed loop 16.

The operation of the water cannon 10 in a continuous flow mode is as follows. As in the pulse mode, the left trigger 90 is depressed to close the first valve 22 and direct the flow of water into the second conduit 30 toward the turret 34. The right trigger 94 is additionally depressed, causing the second valve 36 to be in an open position. Accordingly, the water flows through the base portion 50 and exits the nozzle 38 in a continuous stream.

Operation in a continuous flow mode allows the water cannon to operate both as a conventional fire fighting hose and also as an effective tool for controlling unruly crowds. Additionally, operation in the pulsed mode could allow the water cannon to penetrate areas a normal fire hose cannot reach, providing more effective firefighting and/or crowd control.

The above description and drawings are illustrative of preferred embodiments of the present invention. The invention is defined by the following claims. The present invention should not be limited to the preferred embodiments. Any modification of the preferred embodiments coming within the spirit and scope of the following claims is to be considered part of the present invention.

What is claimed as new and desired to be protected by Letters Patent of the United States is:

1. A liquid dispensing system, comprising:

a nozzle;

a conduit system for supplying liquid to said nozzle, said conduit system including a closed loop for accelerating the liquid and a connector conduit for connecting said closed loop to said nozzle;

a first valve for selectively closing a portion of said closed loop;

a second valve for selectively connecting said nozzle to said connector conduit; and control means for actuating said first and second valves, such that said liquid is dispensed through said nozzle.

2. The dispensing system of claim 1, further comprising a pump for circulating said liquid through said closed loop.

3. The dispensing system of claim 2, further comprising a motor for operating said pump.

4. The dispensing system of claim 3, further comprising a source for supplying said liquid to said closed loop, said source being connected to said closed loop between said first valve and said pump, and a one-way valve for preventing said liquid from flowing from said closed loop to said source.

5. The dispensing system of claim 1, wherein said closed loop is at least about one hundred feet long.

6. The dispensing system of claim 5, wherein said loop comprises a tube having an inner diameter of approximately two inches.

7. The dispensing system of claim 1, wherein said conduit system includes a Y-shaped portion for connecting said closed loop to said connector conduit.

8. The dispensing system of claim 1, further comprising a gas chamber connected to said connector conduit, wherein said control means actuates said second valve in responsive to a predetermined pressure condition within said gas chamber and a first trigger for actuating said first valve, said dispensing system being arranged such that actuation of said first valve causes said liquid to surge into said connector conduit and increase the pressure within said gas chamber to a predetermined pressure condition, such that said second valve is actuated, whereby said liquid is dispensed through said nozzle.

9. The dispensing system of claim 8, wherein said dispensing system is arranged such that dispensing said liquid through said nozzle decreases the pressure in said gas chamber below a predetermined pressure condition, such that said second valve is closed and said nozzle is thereby disconnected from said connector conduit.

10. The dispensing system of claim 9, wherein said valves are solenoid valves.

11. The dispensing system of claim 10, further comprising a second trigger for actuating said second valve regardless of the pressure condition within said gas chamber, such that said dispensing system is arranged to allow a continuos system of said liquid to exit through said nozzle when said first and second valves are in open positions.

12. The dispensing system of claim 11, further comprising a turret for aiming said nozzle and for supporting said triggers, said turret being located between said second valve and said gas chamber.

13. A method of operating a water cannon, said method comprising the steps of:

pumping water through a closed loop such that the water is accelerated therein;

providing a conduit between the closed loop and a nozzle; and subsequently, closing a portion of said closed loop and thereby causing said water to flow through the nozzle.

14. The method of claim 13, wherein said step of causing said water to flow through said nozzle includes the step of dispensing a pulse of said water through said nozzle.

15. The method of claim 13, further comprising the step of causing water to flow through the nozzle such that a continuous stream of said water is sprayed through said nozzle.

16. The method of claim 14 wherein the closing of said portion of said closed loop causes said water to pressurize a gas chamber which upon being pressurized causes a valve for said nozzle to be opened.

17. The method of claim 16, further comprising the step of decreasing the pressure in said gas chamber by flowing water through the nozzle thereby closing said nozzle valve.

18. The dispensing system of claim 1, wherein said control means comprises triggers.

* * * * *